US005808275A

United States Patent [19]

Hibri et al.

[11] Patent Number: 5,808,275

[45] Date of Patent: Sep. 15, 1998

[54] HAIR SHAPING APPARATUS WITH ELECTRICALLY HEATED ROLLERS

[75] Inventors: Dalal Kanafani Hibri; David Allen Monroe, both of San Antonio, Tex.; Chris N. Lenart, San Francisco, Calif.; Beth K. Mosher, Portland, Oreg.; Bryan F. Howell, Austin; David R. Davis, San Antonio, both of Tex.

[73] Assignee: Dalal Kana Fani Hibri, San Antonio, Tex.

[21] Appl. No.: 382,130

[22] Filed: Feb. 1, 1995

[51] Int. Cl.[6] ..... H05B 1/00

[52] U.S. Cl. ..... 219/222; 219/226; 132/229

[58] Field of Search ..... 219/222, 225, 219/226, 541; 132/226, 229, 230, 233, 250, 269

[56] References Cited

U.S. PATENT DOCUMENTS

| | | | |
|---|---|---|---|
| 1,894,612 | 1/1933 | Mayer . | |
| 2,001,915 | 5/1935 | Mabie . | |
| 2,060,102 | 11/1936 | Moseley . | |
| 2,152,343 | 3/1939 | Brown . | |
| 3,487,197 | 12/1969 | D'Elia et al. . | |
| 3,488,471 | 1/1970 | Gstalder . | |
| 3,515,851 | 6/1970 | D'Elia et al. . | |
| 3,519,792 | 7/1970 | Solomon . | |
| 3,523,542 | 8/1970 | Eisler | 219/222 |
| 3,527,237 | 9/1970 | Abe | 219/222 |
| 3,540,457 | 11/1970 | Solomon . | |
| 3,559,658 | 2/1971 | Genest et al. | 219/222 |
| 3,566,886 | 3/1971 | Solomon . | |
| 3,581,055 | 5/1971 | Makino . | |
| 3,673,382 | 6/1972 | Gaffney et al. . | |
| 3,689,736 | 9/1972 | Meyer | 219/222 |
| 3,693,636 | 9/1972 | Tomiati . | |
| 3,760,148 | 9/1973 | Boudouris et al. | 219/222 |
| 3,901,250 | 8/1975 | Tomiati . | |
| 4,075,458 | 2/1978 | Moyer . | |
| 4,101,757 | 7/1978 | Van Dyck et al. . | |
| 4,109,667 | 8/1978 | Quirk . | |
| 4,202,360 | 5/1980 | Walter | 132/226 |
| 4,228,343 | 10/1980 | Kanner et al. . | |
| 4,284,877 | 8/1981 | Abura et al. . | |
| 4,641,010 | 2/1987 | Abura et al. . | |
| 4,743,735 | 5/1988 | Abura et al. . | |
| 4,857,702 | 8/1989 | Cafaro . | |

FOREIGN PATENT DOCUMENTS

| | | |
|---|---|---|
| 629387 | 11/1927 | France . |
| 1965249 | 7/1971 | Germany . |
| 2822327 | 12/1978 | Germany . |

*Primary Examiner*—John A. Jeffery
*Attorney, Agent, or Firm*—Robert C. Curfiss

[57] ABSTRACT

A hair shaping apparatus is provided employing one or more hollow rollers. The rollers can be arranged in concentric fashion and electrically heated by an activator unit, wherein one end of the activator unit is inserted into one end of the concentrically arranged rollers, and the other end of the activator unit can be plugged into an electrical wall outlet. The activator unit can be reversed for storage, whereby the AC plugs which connect to the wall outlet are inserted into the hollow opening of the roller to present a low-profile configuration for ease of portability. One or multiple receptacles can be connected to an activator unit, wherein the activator unit is connected to a wall outlet in order to heat a plurality of singular or concentrically arranged hollow rollers connected to the receptacles.

17 Claims, 7 Drawing Sheets

HAIR SHAPING APPARATUS WITH ELECTRICALLY HEATED ROLLERS

BACKGROUND OF THE INVENTION

1. Field of the Invention

This invention relates to a personal care device and more particularly to an apparatus for shaping hair. The hair shaping apparatus includes hollow, lightweight rollers of varying diameters concentrically arranged and adapted for receiving at one end of each roller an activator unit configured in either a heating or storage orientation.

2. Description of the Relevant Art

It is well known that hair can be curled by placing hair about a heated roller. One or more rollers are allowed to remain in the hair for a period of time necessary to impart a hair curl. Rollers can be either large or small in diameter depending upon the tightness or looseness of the desired curl. If the roller's diameter is small, then the resulting hair might have tight curls. Conversely, if the roller's diameter is large, then the resulting hair might be straightened or will have larger curls, i.e., will pick up a "wave" shape. Depending upon user requirements, it would be advantageous to incorporate both large and small diameter rollers into a heating apparatus in order for the user to "shape" her or his hair (i.e., straighten hair, wave hair, curl hair, or a combination of the three).

Large diameter rollers can be quite cumbersome. Generally speaking, conventional rollers are typically enclosed at one or both ends of the cylindrical shaped member. A large roller which is enclosed can sometimes be quite heavy and prove painful or uncomfortable once placed in the user's hair. The additional weight can place tension to the scalp and/or damage hair follicles. It is therefore desirable to have large rollers dimensioned to wave the hair without adding undue weight to the roller.

Some rollers are heated by a heating source which must be carried along with the roller. The heating source is not easily portable in, for example, the user's purse. The heating source is usually quite large and is typically packaged in its own carrying case. In an effort to increase portability, it is desirable to have a very small heating source, such as a wall plug adapter.

Often associated with each roller is a clip which attaches to the outer surface of the roller to fix hair about the roller. Some conventional clips are made solely of a metallic substance of circular cross-section. The metallic material, after repeated use, can tarnish or rust. The metallic material can conduct heat from the roller and burn the user's fingers during removal from the carrying case and/or heating source. Additionally, ends of the metallic clip are somewhat pointed and can prick the user's hands or scalp during placement. Many conventional clips appear as a wire bent to a desired configuration to match the outer diameter of the roller. The wire, made of semi-malleable material, can bend from its desired configuration rending it useless for future use. It is therefore desirable to achieve a clip with minimal thermal transconductance. The clip must not have pointed ends in order to minimize danger to the user. After repeated usage, the clip must not be susceptible to bending from its desired configuration.

SUMMARY OF THE INVENTION

The problems outlined above are in large part solved by the hair shaping apparatus of the present invention. That is, the hair shaping apparatus hereof includes one or more uniquely shaped rollers. Each roller is hollow. Being hollow, each roller is therefore lightweight. The hair shaping apparatus can accommodate rollers of large diameter. A roller of 5.5 cm outside diameter weighs generally less than 11 ounces.

By making each roller hollow, the roller can maintain a lighter weight and can accommodate very large diameters without damaging, or being uncomfortable to, the user's scalp. Thus, the user can enjoy the benefits of larger rollers without weight detriments. One benefit of large rollers is their ability to straighten or impart waves (volume) to certain types of hair.

Lightweight rollers provide more convenience in the use of both large and small rollers. Both large and small rollers hereof are lighter than conventional, non-hollow rollers. A combination of large and small rollers is used to shape hair as opposed to only curling or waving hair. Shaping the hair encompasses straightening, waving, and/or curling at select locations of the user's hair. Shaping the hair is achieved by heating one or more hollow, lightweight rollers of varying diameters and affixing those rollers at desired locations in the user's hair.

Shaping the hair is carried forth by heating one or more hollow rollers by an activator unit connected at one end of the roller or rollers. If two or more rollers are used, at least two rollers can be concentrically arranged and simultaneously heated by a single activator unit. Hollow design affords the opportunity for smaller diameter rollers to be placed concentrically within larger diameter rollers, and for each roller to be simultaneously heated with a single activator unit.

Concentric design of rollers placed within one another adds to the overall portability and heat ability of the hair shaping apparatus. An activator unit can be inserted into one end of a set of concentrically arranged rollers. After the rollers are heated, the rollers can be disengaged from the activator unit to allow placement of heated rollers into the user's hair. After hair is set, the rollers are removed from the user's hair and affixed for portability purposes in a storage position by placing the activator unit in a reverse orientation into each end of the concentrically arranged rollers. Reversibility of the activator unit and mating of contacts at one end of each roller with receptacles on the activator unit provides a compact storage configuration. Concentrically arranged rollers provide an overall compact design which, when stored, advantageously occupies minimal space in, for example, the user's purse. Moreover, the hair shaping apparatus can be readily removed from the storage location and placed in a heating configuration by reversing the activator unit orientation and coupling the activator unit between an electrical outlet and the rollers.

According to one embodiment, the activator unit is adapted to receive electrical energy and transmit that electrical energy to electric heaters within each roller. Accordingly, the activators unit merely acts as an electrical coupling to the electric heater roller. The electric heater roller thereby heats in response to electrical energy. The activator unit is therefore said to be a passive device, while the roller is an active device. According to an alternative embodiment, the activator unit itself includes an electric heater. In the alternative embodiment, the activator unit converts, via the electric heater contained activator unit, electrical energy to thermal energy. The roller is thereby heated when coupled to the thermally heated activator unit. In the alternative embodiment, the activator unit is said to be an active device, while the roller is considered a passive device. As defined herein, "electric heater" includes any device which converts electrical energy to thermal energy.

Each heated roller is held in position in the hair by one or more clips configured about the outer surface of the roller. The clip or clips of each roller fasten about the hair-surrounded roller and maintain the hair's position during hair-setting operation. The clips are uniquely designed so as not to bend, rust, or tarnish during use. The clips are dimensioned absent substantially pointed terminal ends which could pose a danger to the user. Each clip is designed to appropriately flex but not bend during insertion. Slits arranged partially through the clip may be used to increase flexure of the clip.

Broadly speaking, the present invention contemplates an apparatus for shaping hair. That is, the apparatus can heat rollers of varying diameters to not only curl, but also straighten or wave hair. The hair shaping apparatus comprises a cylindrical, hollow first roller having opposing ends and a conductive material placed between the opposing ends. A first contact is coextensive with the hollow first roller and is coupled between the conductive material and one of the opposing ends. The hollow first roller has an outside dimension sufficient to wave or straighten, as opposed to curl, hair. The outside dimension is preferably greater than 4.0 centimeters in some instances, and greater than 5.5 centimeters in others. Additional rollers (i.e., second, third, etc.) can be concentrically arranged inside the first roller to provide curls dependent upon the outer diameter of each respective roller.

At each opposing end of the cylindrical first roller are handles. The handles comprise a plurality of radially extending protrusions spaced along the hollow first roller extending from respective ends thereof. Each of the plurality of protrusions provide an advantageous gripping surface. Additionally, the protrusions function as heat sinks to dissipate heat associated with adjacent conductive material. The protrusions and thermal dissipation associated therewith ensure palpable grip on the handles and provide user comfort and safety against burns while the handles are gripped.

The conductive material, according to one embodiment, is both thermally conductive and electrically conductive and comprises at least two arcuate metal plates with metal couplings at opposing ends of each plate. An electric heater element is fixed between the pair of metal couplings such that a metal coupling of one metal plate is connected through an electric heaters to a metal coupling of another metal plate. The pair of couplings are adapted to receive electrical energy of opposite polarity from an electrical source connected to the first contact, and the electric heaters are adapted to expel heat to the metal couplings in response to the electrical energy. The arcuate metal plates surround a mid-section of the hollow first roller between the opposing ends. According to another embodiment, the arcuate metal plates comprise a spaced plurality of openings traversing the plate. According to yet another embodiment, each arcuate metal plate includes a lamp housing arranged at the coupling locations. The lamp expels heat in response to electrical energy and also emits visible light indicating the roller is being heated. In yet another embodiment, each arcuate metal plate is replaced such that a resistive heating element electrically connected to the first contact and encapsulated within a dielectric sheath surrounding the mid-section of the hollow roller. According to still another embodiment, the arcuate metal plates are substituted with a layer of wire wrapped about the mid-section. A dielectric layer is affixed to the outer surface of the wire wrapped mid-section.

The present invention further contemplates an activator unit placeable into one end of the hollow first roller as well as other concentrically arranged second, third, etc. rollers. The activator unit comprises opposing first and second sides of circular cross-section. The activator unit includes an AC plug extending from the first side and, according to one embodiment, a single receptacle extending from the second side. As a passive device, the receptacle includes at least one pair of female channels which are attached to the AC plug and dimensioned to mate with corresponding contacts during times in which the receptacle extends into one end of the concentrically arranged rollers. Thus, as a passive device, the receptacle is an electrical receptacle, wherein electrical conduction is formed at the mated female channels and contacts. As an active device, the activator unit also includes an AC plug extending from the first side and, according to one embodiment, a single receptacle extending from the second side. The receptacle can include a pair of female channels or, preferably, a thermally conductive lip, which thermally connects to the contacts or, preferably, a recess formed within the hollow roller.

The activator unit, after heating operation, can be reversed and placed in a storage configuration into one end of the concentrically arranged rollers. Accordingly, the first side of the activator unit from which the AC plug extends is further adapted to partially extend into one end of the roller or rollers. By reversing the activator unit orientation and extending the AC plug into the hollow roller of smallest inner diameter, the hair shaping apparatus can be transformed into a modular, compact configuration and readily stored within, for example, the user's purse.

The present invention further contemplates an activator unit having, according to another embodiment, a plurality of receptacles arranged on one side of an activator unit. Each receptacle is adapted to mate in electrical or thermal connection with a respective roller. Each receptacle thereby has either electrical connection points (i.e., female channels) or thermal connection points (i.e., flanges) to respective contacts or recesses. If more than one roller is to be heated at each receptacle location, the rollers are concentrically arranged and placed in electrical or thermal contact with a corresponding electrical or thermal connection points. The plurality of receptacles can be arranged in an array, and each activator unit is connected to a thermal or electric power source such as that provided by an electrical wall outlet or an electric heater to the wall outlet.

The present invention still further contemplates more than one roller concentrically arranged about each other. Each roller having a respective set of opposing ends, and one end of each roller having a contact coextensive with a respective roller and coupled between a corresponding conductive material associated with the roller and one or the respective ends thereof. An activator unit can be coupled in a heating configuration or in a reversed, portable configuration by frictionally mating receptacles on the activator unit to corresponding contacts on each concentrically arranged roller.

BRIEF DESCRIPTION OF THE DRAWINGS

Other objects and advantages of the invention will become apparent upon reading the following detailed description and upon reference to the accompanying drawings in which.

Figure 1:
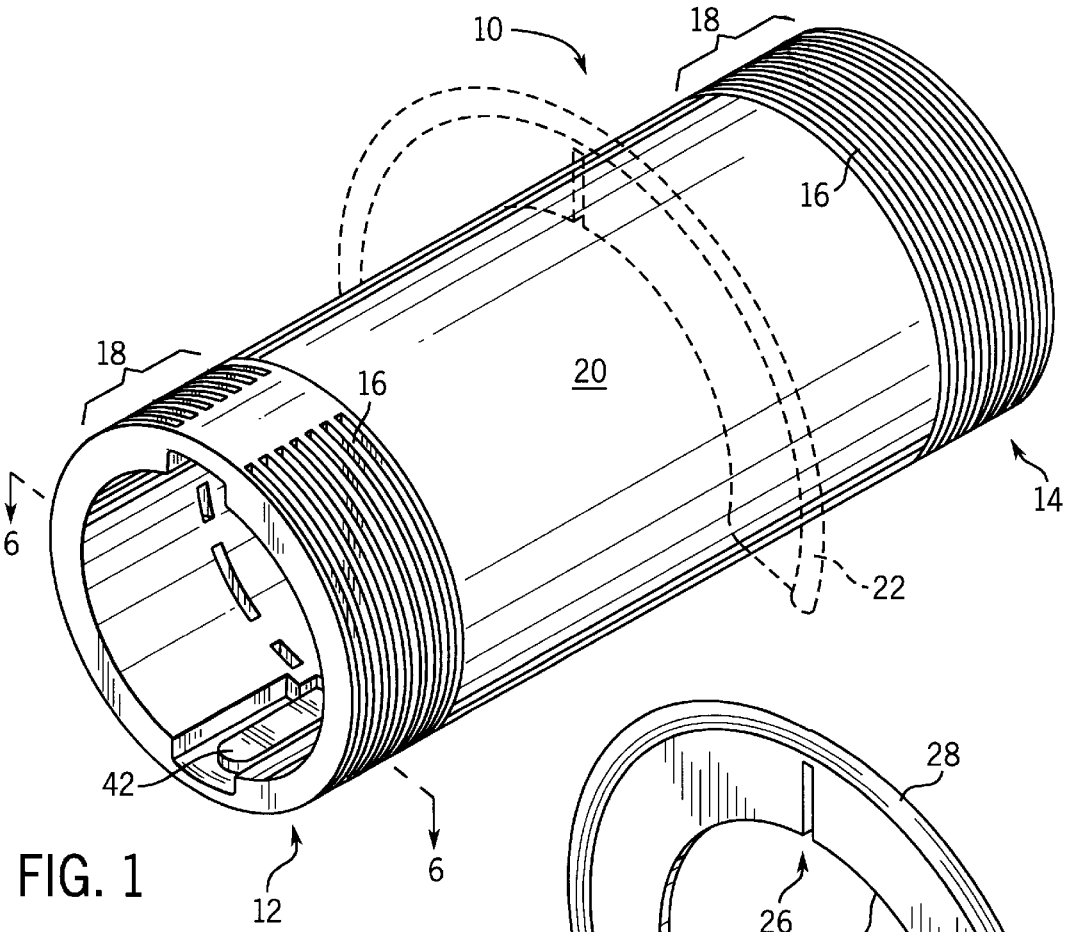
FIG. 1 is a perspective view of a hollow roller having a hair clip arranged, in phantom, about the outer surface of the roller according to the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Referring now the drawings, FIG. 1 illustrates a hollow roller 10 of multiple layer assembly. In particular, hollow roller 10 is cylindrically shaped having two opposing ends 12 and 14. Extending from each end 12 and 14 is a spaced plurality of protrusions 16. Protrusions 16 extend radially outward from the outer surface of roller 10 to present a pair of handles 18 upon which a user can grasp roller 10. Protrusions 16 ensure the operator's hand is less susceptible to slippage from its position on handle 18. Protrusions 16 also operate as heat sinks to dissipate heat away from handle 18 grasp area. Roller 10 can thereby be heated while handles 18 remain relatively cool—i.e., cooler than mid-section 20.

Figure 2:
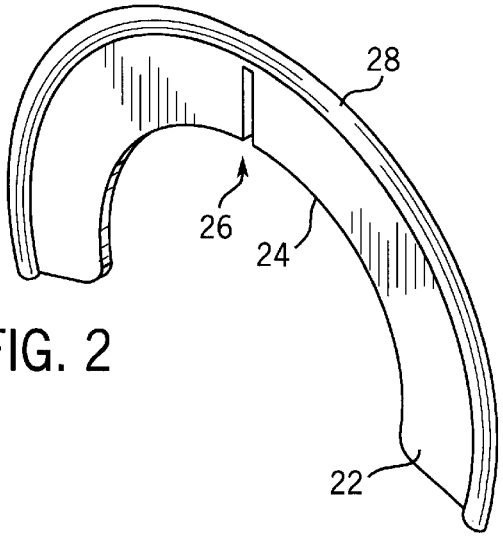
FIG. 2 is a perspective view of the hair clip according to the present invention.

Mid-section 20 between handles 18 has an outer diameter dimensioned to receive a hair clip 22, shown in phantom. Hair clip 22 is shown in FIG. 2 as having an inner semi-circular or C-shaped surface 24. Inner surface 24 is configured to flex outward during insertion over mid-section 20. Flexure may be enhanced by placing one or more slits 26 partially through hair clip 22. At the outer surface of hair clip 22 is a support member 28 of larger cross-section than inner surface 24. Support member 28 can be of unibody construction with inner surface 24 or can be a separate structure, similar to a "spine" which secures about the outer portion of inner surface 24. Member 28 provides support for clip 22 and, during insertion over mid-section 20, does not easily break. The terminal ends of clip 22 comprise not only the terminal ends of support member 26, but also the radially inward projecting portion of clip 22. The larger cross-sectional area of the conjunctive terminal ends helps minimize danger of the terminal ends pricking the user.

Figure 3:
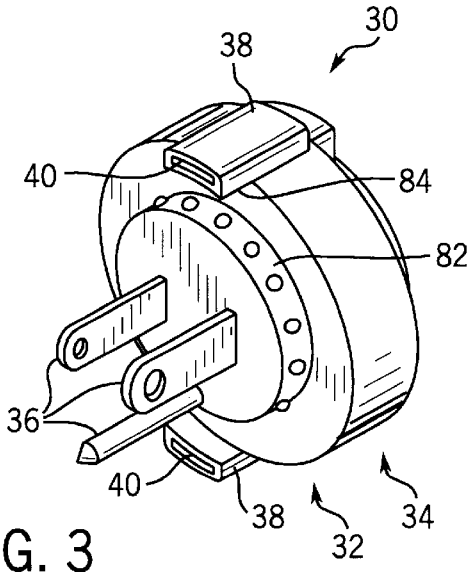
FIG. 3 is a perspective view of an activator unit according to the present invention.

Referring now to FIG. 3, an activator unit 30 is shown having opposing first and second sides 32 and 34, respectively, of circular cross-section. Extending from first side 32 is an AC plug 36. Formed at the outer circumference of activator unit 30 is an receptacle 38. At opposing ends of receptacle 38 is a female channel 40 adapted to frictionally engage with and electrically connect to a contact 42, shown in FIG. 1, and further described in reference to FIG. 5.

Figure 4:
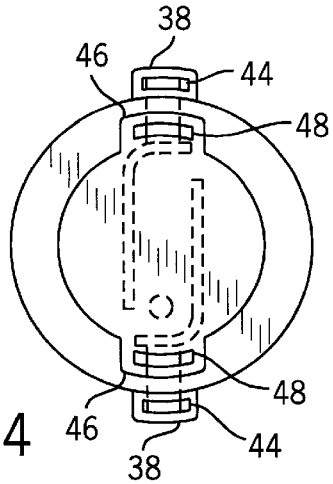
FIG. 4 is a side elevation view of the activator unit of FIG. 3.

Female channel 40 contains a conductive terminal 44 better illustrated in reference to FIG. 4. Conductive terminal 44 is contained within channel 40 and connects to respective conductive elements of AC plug 36 to present electrical energy of opposite polarity to the terminals pairs. Arranged radially inside of receptacle pairs 38 is another pair of receptacles 46. Receptacles 46 also comprise conductive terminals 48 connected to respective conductors of AC plug 36. The combination of first and second pairs of receptacles 38 and 46 provide electrical energy at contact points upon activator unit 30 in registry with corresponding contacts 42 arranged at one end of one roller or a plurality of concentrically arranged rollers. Coupled between the receptacles and each conductor of the AC plug is a heat sink apparatus (not shown). The heat sink is formed within activator unit 30 to sink heat away from the AC plug during times in which roller 10 is being heated.

Figure 5:
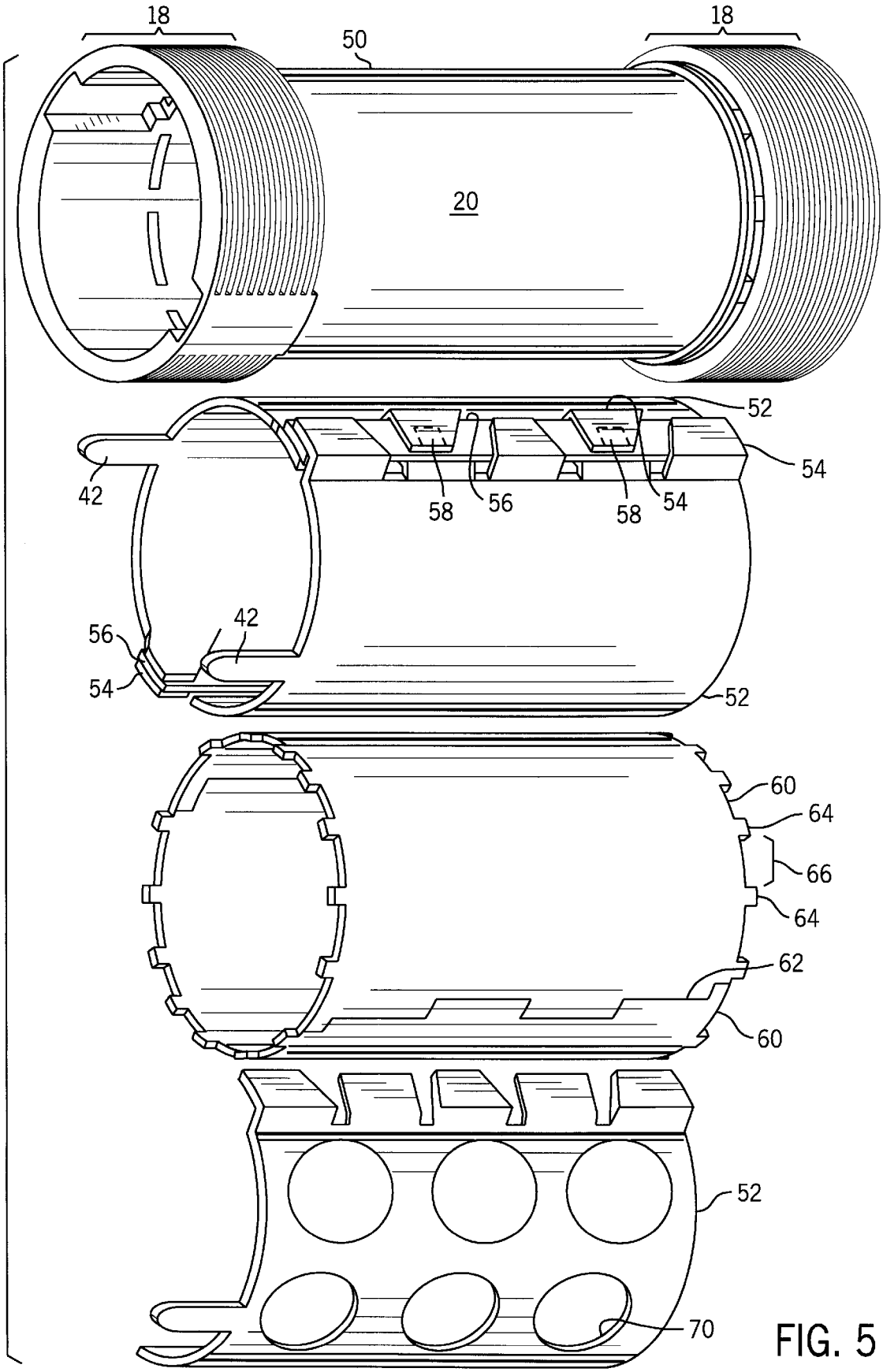
FIG. 5 are perspective views of a hollow roller body having a conductive material, shown in alternative form, placed about a mid-section of the hollow roller body and a dielectric placed about the conductive material according to the present invention.

Turning now to FIG. 5, a perspective view of hollow roller 10 is shown disassembled into various conductive and non-conductive assemblies. Roller 10 comprises a hollow, cylindrical roller body 50. Body 50 is made of a thermally conductive material but is insulative to electrical current. Electrically insulative, thermally conductive body 50 is made of any suitable material which achieves the above-mentioned result.

The outward surface of roller body 50 is configured to receive two or more arcuate, electrically and thermally conductive portions 52 which fits over body 50. Arcuate conductive members 52 couple together at couplings 54 arranged at opposing ends of each member 52. Couplings 54 are spaced apart by an electrical dielectric 56. In openings through dielectric 56 is one or more electric heaters 58, shown in dashed line hidden beneath the outermost coupling. Electric heaters 58 electrically couple between opposing couplings 54 to receive electrical energy transmitted from contact 42 to respective couplings 54. Upon receipt of electrical energy, electric heaters 58 transform the electrical energy to thermal energy. Conductive members 52 are not only electrically conductive but are also thermally conductive to receive thermal energy emitted from electric heaters 58 about area 20. Hair setting surface 74 of area 20 can therefore be heated by electric heaters 58 through conversion of electrical energy to thermal energy. Handles 18 remain relatively cooler than hair setting surface 74 as a result of protrusions 16 and the heat dissipation properties thereof.

Arranged over conductive members 52 is an arcuate-shaped electrically insulative member 60. Insulative member 60 can be fitted or welded together along seam 62 to form a circular cross-section completely encompassing and closely abutting conductive members 52. Member 60 is electrically insulative yet thermally conductive. Member 60 receives thermal energy from conductive members 52 and forwards sufficient quantities of thermal energy to the outside hair setting surface 74 upon which hair resides. Along the arcuate, opposing ends of each member 60 is a plurality of protrusions 64. Space 66 exists between protrusions 64 to minimize thermal conduction from thermally conductive members 60 to abutting handles 18. Thus, thermally conductive members are appropriately configured to maximize thermal energy at hair setting surface 74 while minimizing transferral of said energy to opposing ends, or handles 18.

According to one exemplary embodiment, each conductive member 52 as shown at the bottom of FIG. 5 can include a plurality of apertures 70. Apertures 70 are suitably circular in cross-section. Apertures 70 are formed to lessen the overall weight of conductive member 52. Therefore, according to one embodiment, the metallic material used to form conductive members 52 can be lessened in overall weight by apertures 70 formed therein. It is important when deriving a roller of large diameter that weight be minimized, when placed, to reduce the overall stress on the hair follicles and scalp.

Figure 6:
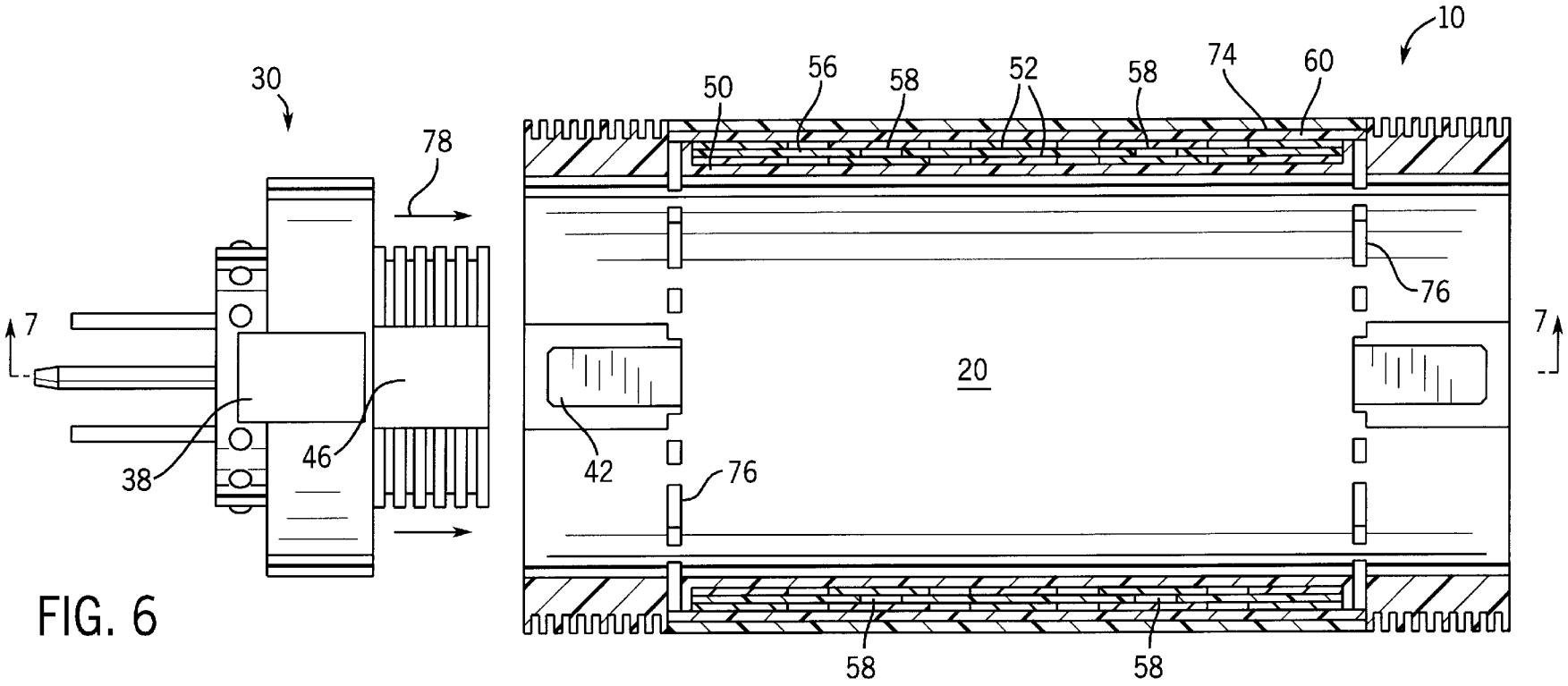
FIG. 6 is a cross-sectional view along plane 6 of FIG. 1 with a side view of the activator unit shown in registry with one end of the hollow roller according to the present invention.

Turning now to FIG. 6, a cross-sectional view of hollow roller 10 along plane 6 of FIG. 1 is shown. Also shown is a side elevational view of activator unit 30. Activator unit 30 and hollow roller 10 are shown in a unmated position with receptacles 38 arranged in alignment with contacts 42. Various layers of electrically conductive and electrically insulative material are arranged along mid-section 20. The innermost layer is denoted as roller body 50. Abutting against the outward surface of roller body 50 are conductive members 52. The cross-sectional plane of FIG. 6 illustrates upper surface couplings and lower surface couplings arranged on opposing surfaces of dielectric 56 and transducers 58. In thermal conduction with the outer surface of conductive members 52 is electrically insulative member 60. Member 60 transfers thermal energy but blocks electrical energy from conductive members 52 to a hair-setting surface 74. Hair-setting surface 74 is made up of a moderately thermally conductive material wrapped about member 60 upon which the users hair is affixed with hair clip 22. Traversing roller body 50 is a series of apertures 76 which partially separate mid-section 20 from handle areas 18. Apertures 76 thereby minimize thermal energy transferal from mid-section 20 to handles 18.

Arranged within the inner diameter of hollow roller 10 is at least one contact 42. Contact 42 is adapted to electrically connect with terminals arranged within female channel 40 of receptacle 38. Thus, during heating operations, activator unit 30 is slid into the opening of one end of roller 10 in the direction of arrows 78. As activator unit 30 is placed within roller 10, contacts 42 frictionally engage and electrically mate with the terminals within female channel 40 of respective receptacles 38.

Figure 7:
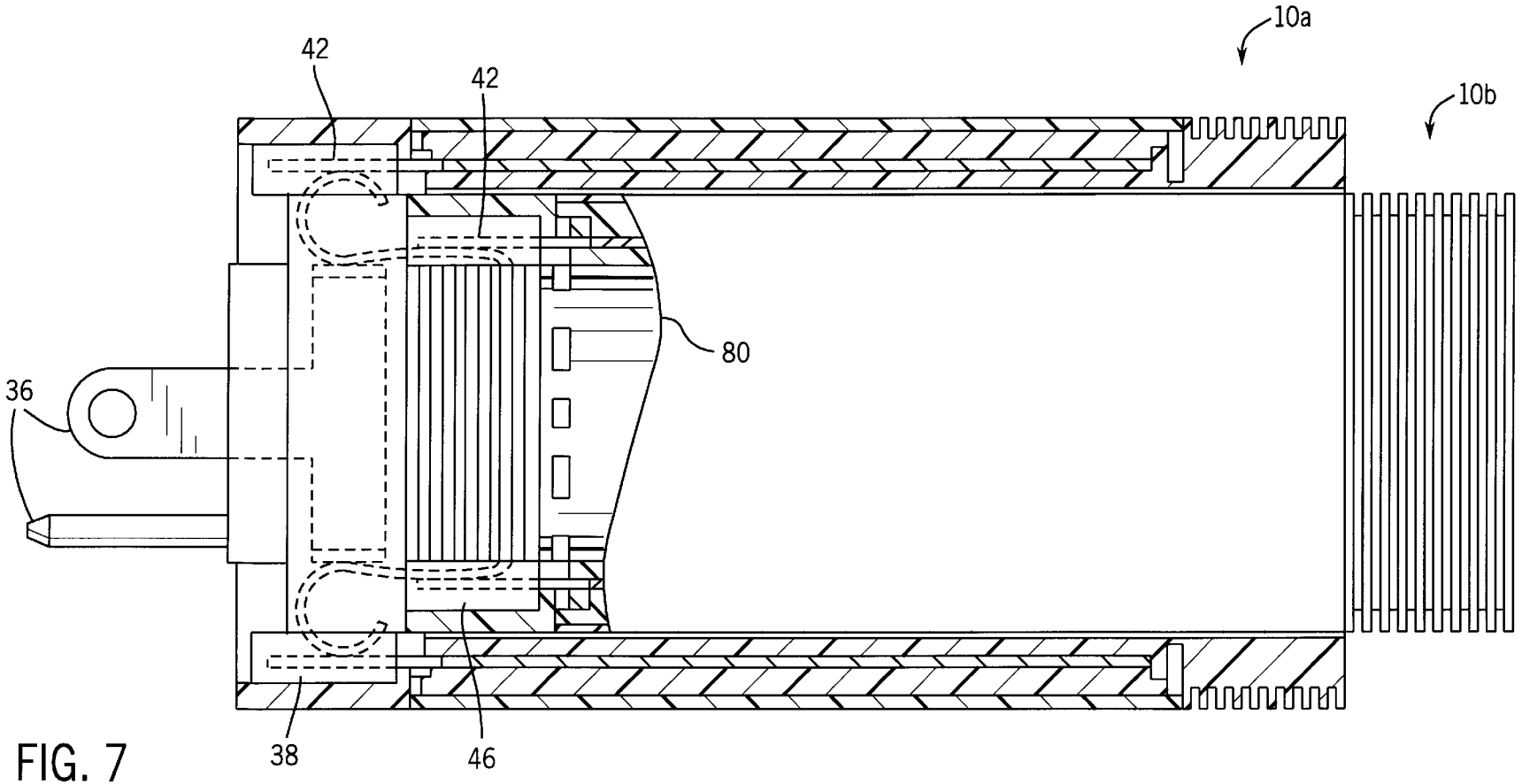
FIG. 7 is a cross-sectional view along plane 7 of FIG. 6 with a side view of the activator unit placed into one end of the hollow roller and further showing a partial breakaway of another hollow roller concentrically arranged inside the previous hollow roller to receive mutual connection with the activator unit.

In the exemplary embodiment shown in FIG. 7, two hollow rollers 10*a* and 10*b* are arranged concentric with each other and electrically mated with activator unit 30. It is understood, however, that numerous hollow rollers can be arranged concentric with each other and mated with a singular activator unit 30 provided the hollow dimensions of each roller is appropriately maintained and provided activator unit 30 is configured with sufficient receptacles to fixedly engage each roller. FIG. 7 illustrates cross-sectional views of an exemplary pair of concentrically arranged hollow rollers 10*a* and 10*b*. The outer diameter of the smaller roller 10*b* is dimensioned slightly less than the inner diameter of the larger hollow roller 10*a*. A portion of the smaller roller 10*b* is cut away along line 80 to expose the mating connection of a pair of receptacles 46 of activator unit 30 with respective contacts 42 extending from the smaller roller 10*b*. Radially and laterally displaced from the mating arrangement of small roller-to-activator unit is a similar mating arrangement between the large roller-to-activator unit. Large and small rollers 10*a* and 10*b* can therefore be simultaneously heated by electrical transferral from AC plug 36 to two sets of contacts arranged upon rollers 10*a* and 10*b*.

Referring to the combination of FIGS. 3 and 7, it is appreciated that activator unit 30 can be reversed in its orientation for storage inside the concentrically arranged rollers. In particular, the surface from which AC plugs 36 extend can be directed into the hollow opening of the smaller roller whereby plugs 36 are hidden inside the concentric arrangement. A lip 82, shown in FIG. 3, abuts against the inside diameter of the smaller roller. The outer surface of lip 82 fixedly engages against opposing surfaces at one end of the smaller roller to maintain its concentricity inside the larger roller. Meanwhile the larger roller is fixed in position about the smaller roller by the engagement of contacts 42 into female channel 40. Reversal of activator unit 30 and the engagement of the activator unit with two or more concentrically arranged rollers provides a compact storage configuration, whereby the user can easily place the entire hair shaping apparatus hereof into a smaller portable storage space such as a purse.

Figure 8:
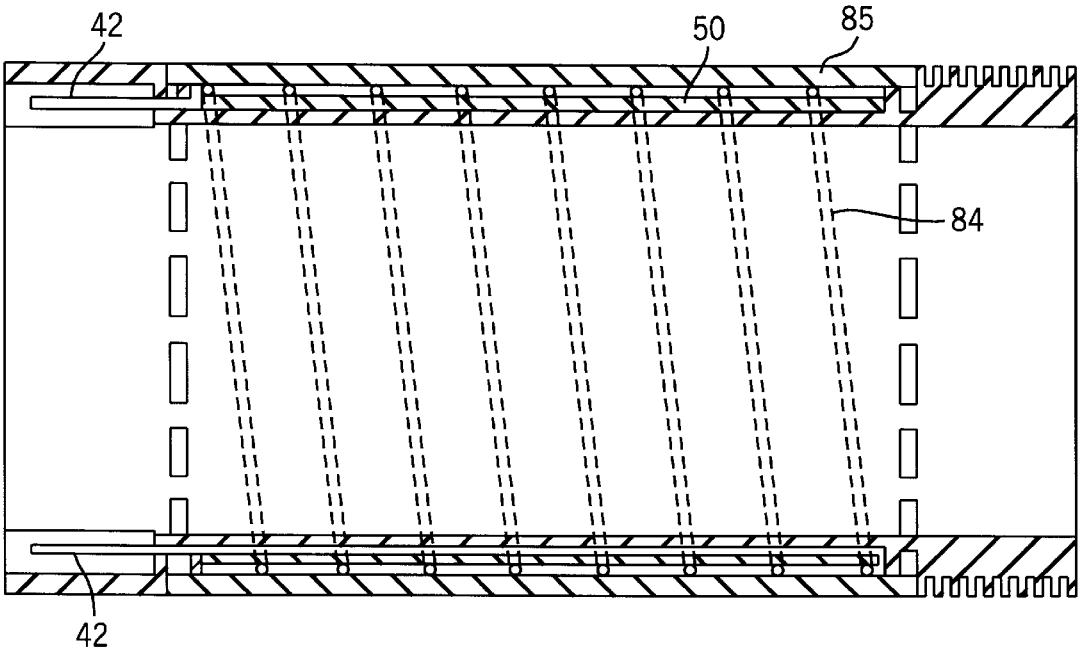
FIG. 8 is a cross-sectional view of the hollow roller having a resistive wire heating element wrapped about the mid-section of the hollow roller body according to one exemplary embodiment of the present invention.
Figure 9:
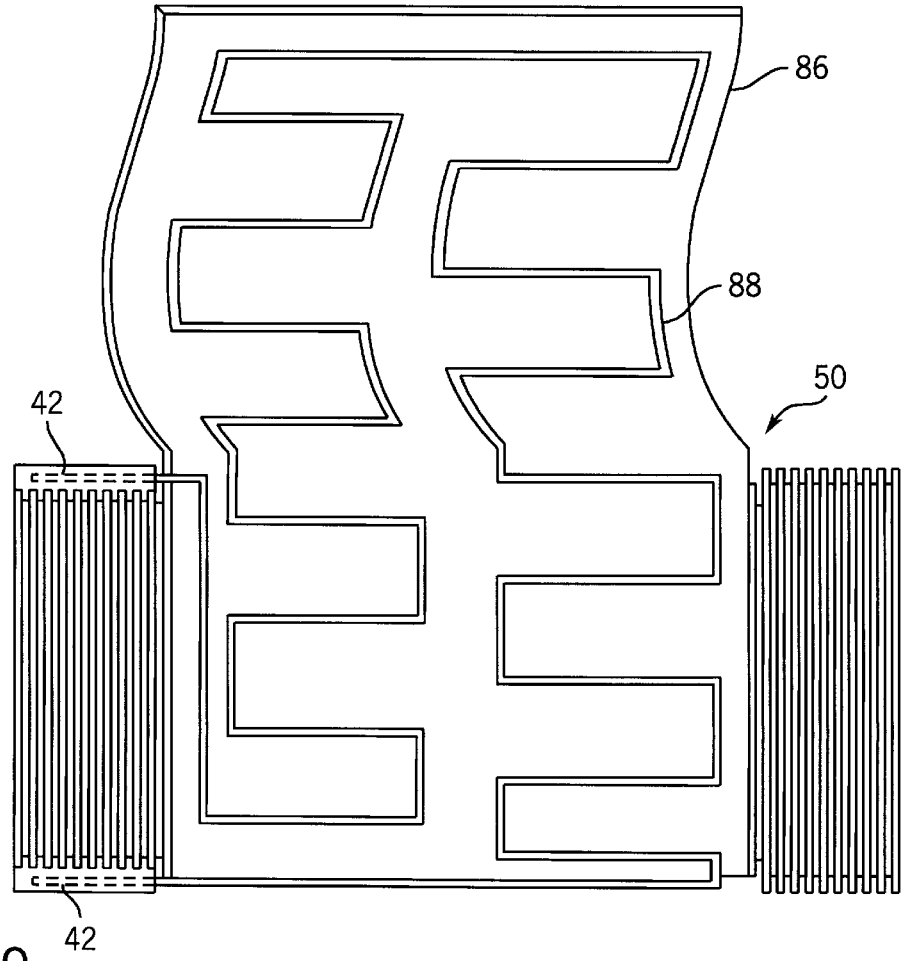
FIG. 9 is a side view of the hollow roller having a printed resistive element shown encapsulated within an electrically insulative material and wrapped about the mid-section of the hollow roller body.

Referring now to FIGS. 8 and 9, various embodiments are shown of heating devices 84 and 86. Device 84 of FIG. 8 consists of a resistance wire heating element. Wire 84 is evenly wrapped about mid-section 20 of roller body 50. Wire 84 is encircled by a thermally conductive, electrically insulative material 85. The user's hair can be wound about material 85 to receive thermal energy emitted from wire 84 through material 85. Connected to terminal ends of wire 84 are contacts 42.

FIG. 9 illustrates yet another exemplary embodiment in which a printed resistive element 88 is deposited upon or configured radially inside of an electrically insulative material. Printed resistive element 88 is connected at terminal ends to contacts 42. FIG. 9 indicates contacts 42 in dashed line relative to the side elevational view of roller body 50. Embedded resistive element 88 of thermally conductive material 86 are wrapped about mid-section 20 of roller body 50. The terminal ends of material 86 are connected to complete the configuration and present a heated surface about which hair can be placed. The thermally conductive material 86 also suffices to store thermal energy.

Whether the chosen embodiment is a electric heaters FIGS. 5 and 6, a resistive wire wrapping as shown in FIG. 8, or printed wire as shown in FIG. 9, the resulting effect remains the same. That is, the heating element receives electrical energy and converts the electrical energy to thermal energy. Regardless of the heating arrangement being used, or a possible combination of heating arrangements, any device which receives electrical energy and heats at the mid-section of a hollow roller in response to electrical energy falls within the scope and spirit of the present invention. A thermostatic control element (not shown) may be used to modulate or regulate heating of various conductive devices such as the resistive wire. The thermostatic control element is preferably coupled in series with the resistance element and can be located either within the hollow roller body 50 or on activator unit 30. As shown in FIG. 9, it is appreciated that the printed resistive element 88 is distributed in a uniform fashion about mid-section 20.

Figure 10:
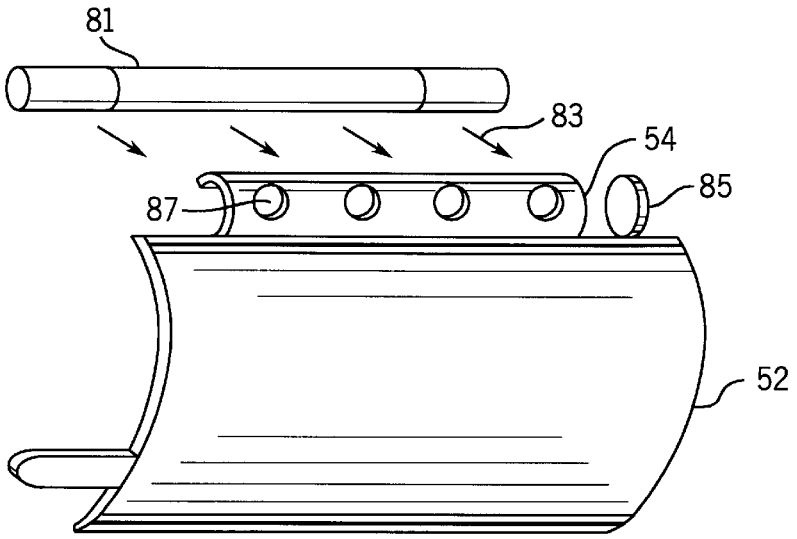
FIG. 10 is perspective view of the conductive material placeable about the hollow roller body, wherein the conductive material is adapted to receive a lamp according to one exemplary embodiment of the present invention.

FIG. 10 illustrates according to one embodiment a conductive member 52 having a coupling 54 adapted to receive a lamp 81. Coupling 54 has an inner dimension which snugly receives lamp 81 outer surface. Another member 52 and coupling 54 (not shown) allows lamp 81 to be securely held in position as shown by arrows 83. Lamp 81 is lit by securing it between a pair of terminals. One terminal 85 is formed on one member, while another terminal (not shown) is formed on another member. During application of electrical energy, lamp 81 emits heat which correspondingly heats conductive member 52. Moreover, lamp 81 emits light which traverses apertures 87 of coupling 54. The emitted light is preferably visible to the user in order to indicate that the roller is receiving power.

Figure 11:
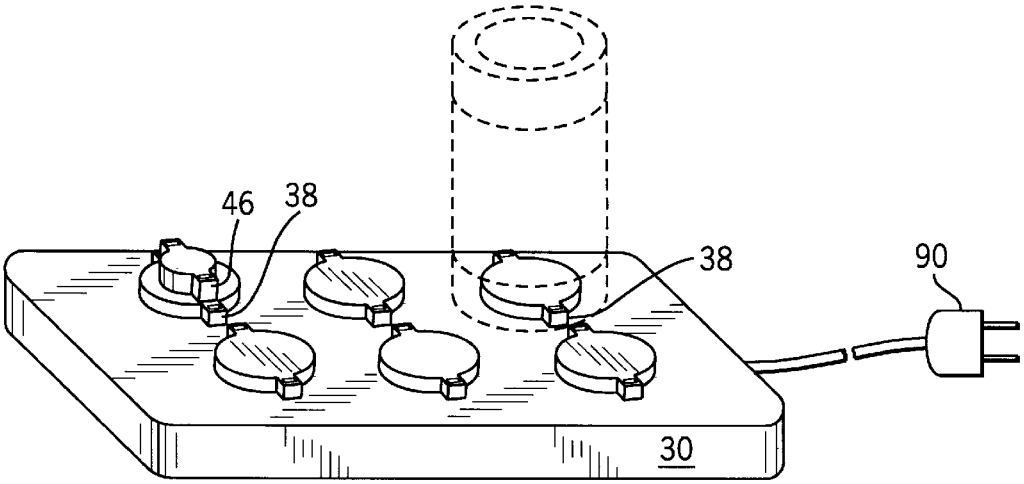
FIG. 11 is a perspective view of an activator unit having a plurality of receptacles, each receptacle is dimensioned to receive one end of a respective roller or concentrically arranged multiple rollers so as to simultaneously heat the rollers through electrical transferral in accordance with the present invention.

FIG. 11 illustrates an activator unit 30 having a plurality of receptacles (receptacles 38 and/or 46). Each receptacle is adapted for receiving one end of a single roller or one end of two or more concentrically arranged rollers. Each receptacle receives electrical energy from a common source 90. Further, each receptacle (either receptacles 38 or 46) can be arranged to connect with one hollow roller (shown in phantom) or a plurality of concentric rollers. The rollers are connected to extend in a vertical orientation. After the hollow rollers are sufficiently heated, the user can remove the rollers from the electrical activator 30 and place them in her or his hair.

Figure 12:
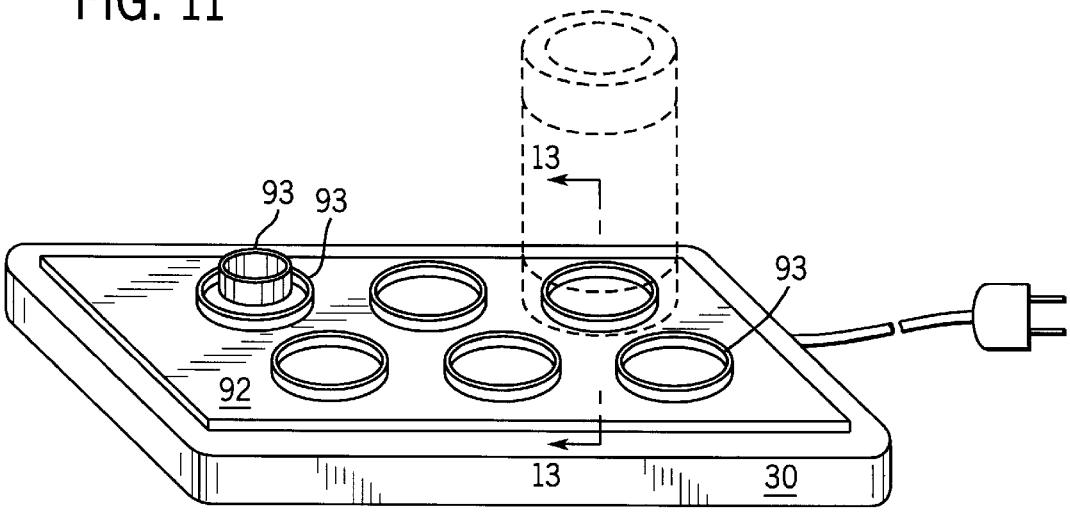
FIG. 12 is a perspective view of an activator unit having a plurality of receptacles dimensioned to receive one end of a roller or concentrically arranged multiple rollers so as to simultaneously heat the rollers through thermal transferral in accordance with the present invention.

FIG. 11 illustrates transferral of electrical energy from activator unit 30 to respective rollers, whereas FIG. 12 illustrates transferral of thermal energy from activator unit 30 to respective rollers. The configuration of FIG. 12 indicates activator unit 30 capable of emitting thermal energy from a contiguous heating plate 92 to corresponding receptacles 93 (shown as flanges). Receptacles 93 are receive thermal energy from heating plate 92 and are arranged in an array, each as singular rings or as concentric rings extending from plate 92. Heating plate 92 is capable of converting AC power into thermal energy. Heating plate 92 is heat regulated and is capable of maintaining its temperature within a desired range to eliminate or minimize danger to the user.

Figure 13A:
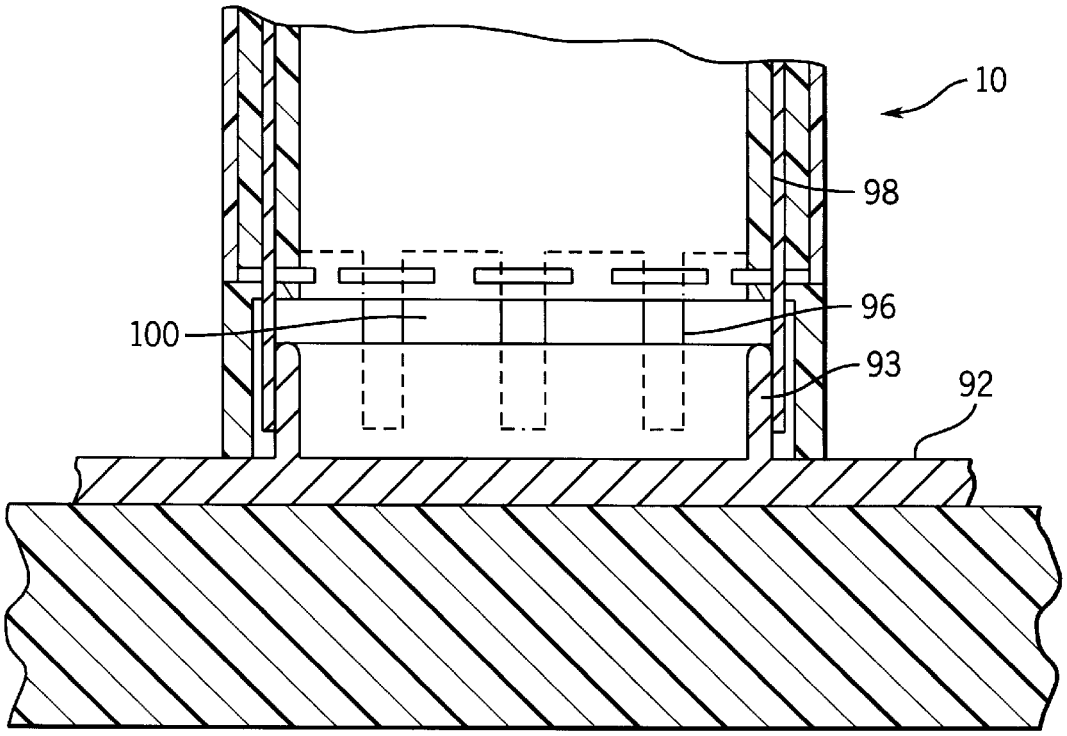
FIG. 13A is a cross-sectional view along plane 13 of FIG. 12 illustrating, according to one exemplary embodiment, passive thermal conduction between the activator unit and the hollow rollers according to the present invention.
Figure 13B:
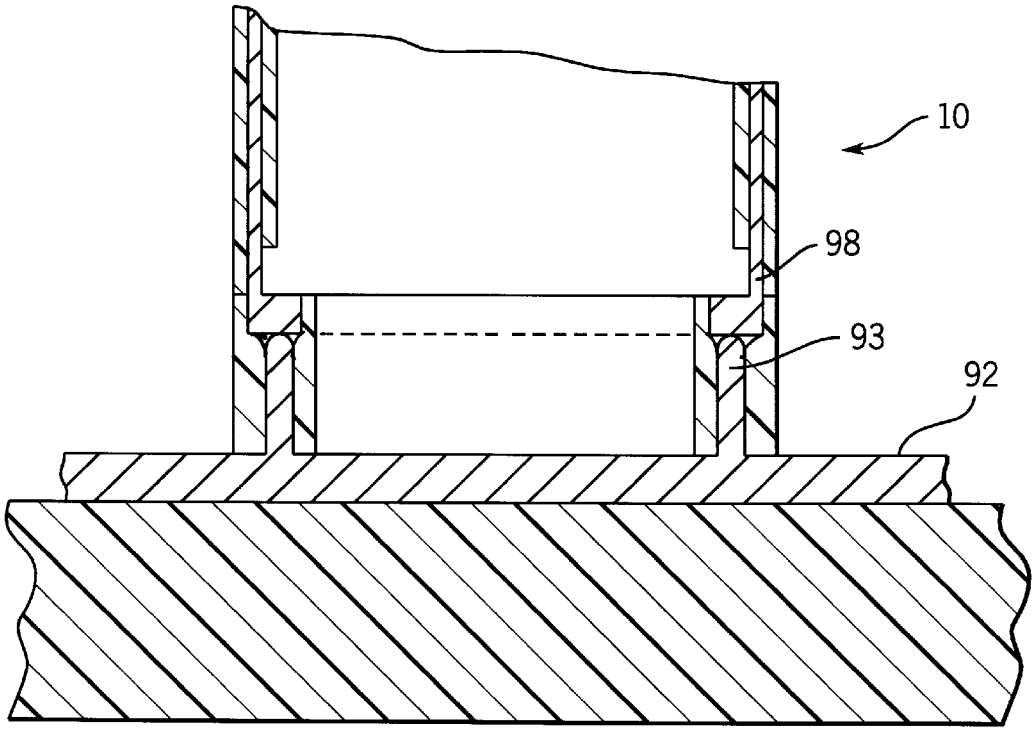
FIG. 13B is a cross-sectional view along plane 13 of FIG. 12 illustrating, according to another exemplary embodiment, passive thermal conduction between the activator unit and the hollow rollers according to the present invention.

FIG. 13A illustrates according to one embodiment a cross-sectional view along plane 13 of FIG. 12. Heating plate 92 is shown contiguous with the upward extending heat transfer rings 93 to present a thermal source on which multiple rollers 10 can engage in a vertical fashion. Thermal transfer rings 93 are mated with the inside surface of conductive fingers 96 so as to transfer thermal energy from rings 93 through conductive fingers 96 to conductive members 98. When fully connected, there remains an open space or gap 100 between roller 10 and the upper surface of rings 94. Conductive fingers 96 thereby suffice as contacts connected to the outside surface of receptacle (i.e., rings) 93.

FIG. 13A illustrates according to another embodiment a cross-sectional view along plane 13 of FIG. 12. Heating plate 92 is shown contiguous with the upward extending heat transfer rings 93. The heat transfer rings couple within recesses at the end of roller 10. Arranged within the recesses which encircle at least a portion of the terminal end of roller 10 are terminating portions of conductive members 98. Conductive members 98 are thereby contained within the recesses away from physical contact by the user's hand, etc.

It will be appreciated to those skilled in the art having the benefit of this disclosure that this invention is believed to be capable of shaping hair. Specifically, hollow rollers of varying diameters can shape hair, e.g., curl, wave and/or straighten hair to any desired configuration. It is also to be understood that the form of the invention shown and described is to be taken as presently preferred, exemplary embodiments. Various modifications and changes may be made without departing from the spirit and scope of the invention as set forth in the claims. For example, numerous techniques can be employed to heat a thermally conductive surface about which hair can be wrapped so as to set hair in accordance with the shaping techniques described herein. Such modifications, given the benefit of this disclosure, would be obvious to a person skilled in the art. It is therefore intended that the following claims be interpreted to embrace all such modifications and changes and, accordingly, the specification and drawings are to be regarded in an illustrative rather than a restrictive sense.

What is claimed is:

1. An apparatus for shaping hair adapted to be heated by applying an external energy source to the apparatus, comprising a cylindrical; hollow first roller having opposing ends and an inner wall and an outer wall for defining an open tubular member having an open cavity extending the length of the roller, and a conductive material placed between said opposing ends and between the inner and outer wall, the conductive material comprising at least two arcuate metal plates with a metal coupling at opposing ends of each metal plate, and a heating element disposed between the metal couplings, said arcuate metal plates surrounding a mid-section of said hollow first roller between said opposing ends such that said heating element is coupled between a metal coupling of one metal plate and a metal coupling of another metal plate, whereby the external energy source is placed in contact with the conductive material at one end of said opposing ends of the roller.

2. An apparatus for shaping hair adapted to be heated by applying an external energy source to the apparatus, comprising a cylindrical, hollow first roller having opposing ends and an inner wall and an outer wall for defining an open tubular member having an open cavity extending the length of the roller, and a conductive material placed between said opposing ends and between the inner and outer wall, the conductive material comprising at least two arcuate metal plates with a metal coupling at opposing ends of each metal plate, and a heating element disposed between the metal couplings, each said arcuate metal plate comprises a spaced plurality of openings traversing said plate, whereby the external energy source is placed in contact with the conductive material at one end of said opposing ends of the roller.

3. An apparatus for shaping hair, comprising:

a cylindrical, hollow first roller having opposing ends and a conductive material placed between said opposing ends;

a first contact associated with said hollow first roller and coupled between said conductive material and one of said opposing ends;

a cylindrical, hollow second roller having an outside diameter less than an inside diameter of said hollow first roller, said hollow second roller having opposing ends and a second conductive material placed between said opposing ends; and a second contact coextensive with said hollow second roller and coupled between said second conductive material and one end of said hollow second roller.

4. The apparatus as recited in claim 3, further comprising:

an activator unit having opposing first and second sides of circular cross-section;

an AC plug extending from said first side; and at least two receptacles attached to said AC plug and extending in spaced relation from said second side, wherein said second side is adapted to partially extend into one end of said hollow second roller and one of said at least two receptacles is adapted to connect with said second contact.

5. The apparatus as recited in claim 3, further comprising:

an activator unit having opposing first and second sides of circular cross-section;

an AC plug extending from said first side; and at least two receptacles attached to said AC plug and extending in spaced relation from said second side, wherein said second side is adapted to partially extend into one end of said hollow first and second rollers arranged in concentric fashion, and wherein said at least two receptacles are adapted to connect with said first and second contacts, respectively.

6. The apparatus as recited in claim 3, further comprising:

an activator unit having opposing first and second sides of circular cross-section; and an AC plug extending from said first side, and wherein said first side is adapted to partially extend into one end of said hollow first and second rollers arranged in concentric fashion.

7. An apparatus for shaping hair, comprising:

a cylindrical, hollow first roller having opposing ends and a conductive material placed between said opposing ends;

a first contact coextensive with said hollow first roller and coupled between said conductive material and one of said opposing ends;

and activator unit having opposing first and second sides of circular cross-section, wherein an AC plug extends from said first side and a first receptacle connected to said AC plug extends from said first side to said second side; and a cylindrical, hollow second roller concentrically configured inside said hollow first roller, wherein the first side of said activator unit is adapted to partially extend into one end of said hollow first and second rollers such that said AC plug faces inward into said hollow first roller and the concentricity of said hollow first and second rollers is fixedly maintained.

8. The apparatus as recited in claim 7, wherein the second side of said activator unit is adapted to partially extend into one end of said opposing ends such that said first receptacle frictionally connects with said first contact and said AC plug is exposed for connection to an AC wall socket.

9. The apparatus as recited in claim 7, wherein the first side of said activator unit is adapted to partially extend into one end of said opposing ends such that said first receptacle frictionally connects with said first contact and said AC plug faces inward into said hollow first roller.

10. The apparatus as recited in claim 9, wherein the second side of said activator unit further comprising a second receptacle spaced radially inside said first receptacle.

11. The apparatus as recited in claim 10, further comprising a cylindrical, hollow second roller having a second contact coextensive therewith, wherein said hollow second roller is concentrically configured inside said hollow first roller, and wherein the second side of said activator unit is adapted to partially extend into one end of said hollow first and second rollers such that said first and second receptacles connect with respective said first and second contacts.

12. The apparatus as recited in claim 11, further comprising a plurality of concentrically arranged hollow first and second rollers and a plurality of activator units, each concentrically arranged hollow first and second rollers having respective first and second contacts extending in frictional mating arrangement with respective first and second receptacles of each of said plurality of activator units.

13. The apparatus as recited in claim 12, wherein said frictional mating arrangement provides thermal conduction between said plurality of concentrically arranged hollow first and second rollers and respective plurality of activator units.

14. The apparatus as recited in claim 12, wherein said frictional mating arrangement provides electrical conduction between said plurality of concentrically arranged hollow first and second rollers and respective plurality of activator units.

15. The apparatus as recited in claim 7, wherein said first roller outside diameter is greater than 5.5 cm and said second roller outside diameter is greater than 4.0 cm.

16. The apparatus as recited in claim 7, wherein said first roller weight is less than 11 ounces and said second roller weight is less than 3 ounces.

17. An apparatus for shaping hair, comprising:

cylindrical, hollow first and second rollers each having opposing ends and a first and second conductive material placed between respective sets of opposing ends;

first and second contacts coextensive with respective said hollow first and second rollers, said first and second contacts are coupled between respective first and second conductive material and one end of respective opposing ends;

an activator unit having opposing first and second sides of circular cross-section;

an AC plug extending from the first side of said activator unit and a pair of spaced first and second receptacles attached to said AC plug and extending from said second side wherein, during operation, said second side is adapted to partially extend into one end of said opposing ends such that the hollow first and second rollers are concentrically fixed about one another, said first and second receptacles connect with respective said first and second contacts and said AC plug is exposed for connection to an AC wall socket, and during storage, said first side is adapted to partially extend into one end of said opposing ends such that the hollow first and second rollers are concentrically fixed about one another, and said AC plug faces inward into the hollow first roller.

* * * * *

UNITED STATES PATENT AND TRADEMARK OFFICE

CERTIFICATE OF CORRECTION

PATENT NO. : 5,808,275

DATED : September 15, 1998

INVENTOR(S) : Dalal Kanafani Hibri et al

It is certified that error appears in the above-identified patent and that said Letters Patent is hereby corrected as shown below:

Title Page

[73] Assignee: Delete (Dalal Kana Fani Hibri) -- Replace with Dalal Kanafani Hibri Signed and Sealed this Fourth Day of May, 1999

*Attest:*

*Attesting Officer*

Q. TODD DICKINSON

*Acting Commissioner of Patents and Trademarks*